US005308259A

United States Patent [19]

Liao

[11] Patent Number: 5,308,259

[45] Date of Patent: May 3, 1994

[54] COMMUNICATION PLUG

[76] Inventor: Lu-Lee Liao, No. 22, 23rd Road, Taichung Industrial Park, Taichung, Taiwan

[21] Appl. No.: 71,402

[22] Filed: Jun. 7, 1993

[51] Int. Cl.[5] ..... H01R 4/38

[52] U.S. Cl. ..... 439/320; 439/469

[58] Field of Search ..... 439/312, 313, 314, 320, 439/321, 469, 471, 473

[56] References Cited

U.S. PATENT DOCUMENTS

| | | | |
|---|---|---|---|
| 3,732,527 | 5/1973 | McKnight | 439/320 X |
| 4,066,314 | 1/1978 | Williams | 439/321 X |
| 4,310,213 | 1/1982 | Fetterolf, Sr. et al. | 439/469 X |
| 4,367,002 | 1/1983 | Waghorn et al. | 439/314 |
| 4,736,999 | 4/1988 | Marks et al. | 439/314 |

*Primary Examiner*—Larry I. Schwartz
*Assistant Examiner*—Khiem Nguyen
*Attorney, Agent, or Firm*—Browdy and Neimark

[57] ABSTRACT

A communication plug comprises a cylindrical housing and a fastening ring. The cylindrical housing is provided therein with a space for receiving therein a connection guide wire and an insulator. The cylindrical housing is fitted into the fastening ring which has an inner threaded segment for fastening with a jack of a main machine. The fastening ring is further provided with a retaining ring having a plurality of indentations located in the circumference thereof. The cylindrical housing has a front end provided thereon with a rear cylindrical segment and further has a recessed segment located between the flange and the rear cylindrical segment. One end of the rear cylindrical segment, which is adjacent to the recessed segment, has a diameter greater than a diameter of another end of the rear cylindrical segment. The retaining ring has an inner diameter smaller than the largest diameter of the rear cylindrical segment. The retaining ring can be forced to deform so as to permit the fastening ring to be fitted securely over the recessed segment of the cylindrical housing.

3 Claims, 2 Drawing Sheets

COMMUNICATION PLUG

FIELD OF THE INVENTION

The present invention relates to a communication equipment, and more particularly to an improved communication plug.

BACKGROUND OF THE INVENTION

A communication microphone is generally provided with an extendable cord having a plug that can be fitted into a jack of a main communication outlet for making an electrical contact. The plug must be so securely fitted into the jack that the plug can not be pulled out accidentally. The prior art plug has a metal housing which is encased by a collar having a threaded hole, which must be small enough to ensure that the collar does not disengage the housing of the plug. The cost of making such a communication plug of the prior art is relatively high. In addition, the manufacture of the prior art plug includes a plating process, which is a source of the environmental pollution. Furthermore, the plug housing must be punched and tapped, thereby resulting in an additional increase in the cost of making the communication plug of the prior art.

SUMMARY OF THE INVENTION

It is therefore the primary objective of the present invention to provide a communication plug, which can be made easily at a low cost.

It is another objective of the present invention to provide a communication plug, which is made in a process devoid of plating.

It is still another objective of the present invention to provide a communication plug, which is light in weight and is well-insulated.

In keeping with the principles of the present invention, the foregoing objectives of the present invention are accomplished by a communication plug which comprises a housing of cylindrical construction and a fastening ring. The housing and the fastening ring are made integrally of plastic material. The hollow housing contains therein a connection guide wire and an insulator. The fastening ring is fitted over the housing and provided therein with an inner threaded hole. The fastening ring is further provided at one end thereof with a retaining ring having an inner diameter smaller than the diameter of the inner threaded hole. The periphery of the retaining ring has a plurality of indentations. The housing is provided at the front end thereof with a flange and at the rear end thereof with a rear segment of an appropriate length. The flange and the rear cylindrical segment have respectively an outer diameter greater than an outer diameter of a recessed segment of the housing. The diameter of one end of the rear cylindrical segment adjacent to the recessed segment is greater than the diameter of another end of the rear segment. In other words, the rear segment is slightly tapered. The inner diameter of the retaining ring of the fastening ring is smaller than the largest diameter of the rear cylindrical segment. However, the housing can be fitted into the fastening ring from the end having a smaller diameter. The retaining ring can be caused to deform so that the fastening ring can be fitted over the recessed segment of the housing. As a result, the fastening ring can not be caused to disengage the housing. The cylindrical housing and the fastening ring can be easily made in one step of the manufacturing process.

DETAILED DESCRIPTION OF THE INVENTION

Figure 1:
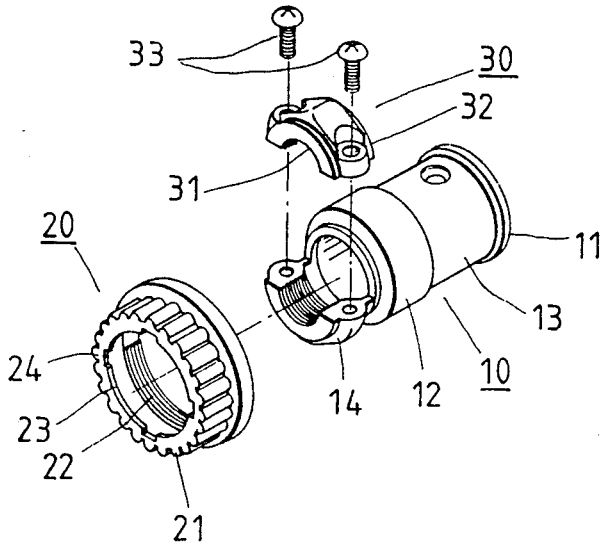
FIG. 1 shows an exploded view of the present invention.
Figure 2:
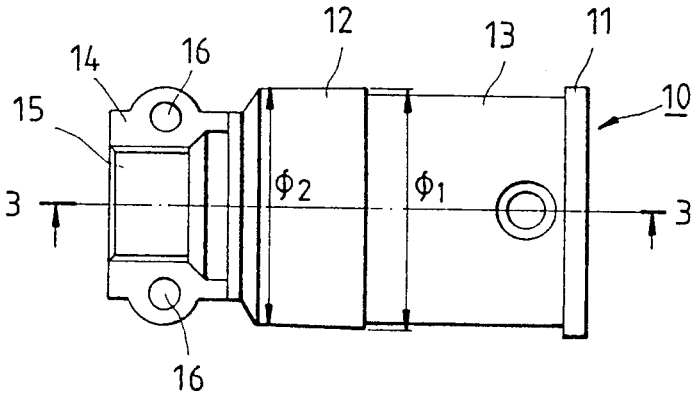
FIG. 2 shows a top elevational view of the plug housing of the present invention as shown in FIG. 1.
Figure 3:
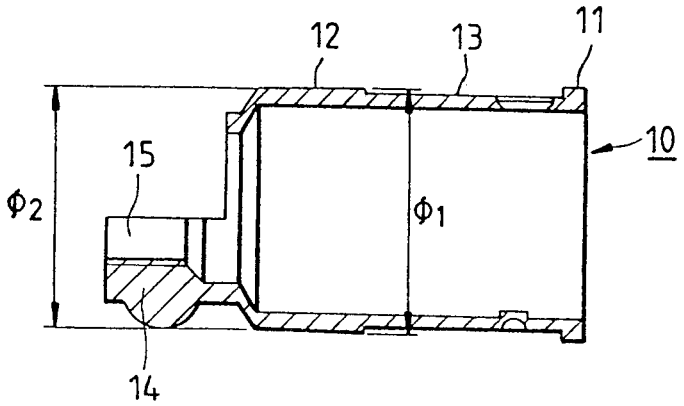
FIG. 3 shows a sectional view of a portion taken along the line 3—3 as shown in FIG. 2.
Figure 4:
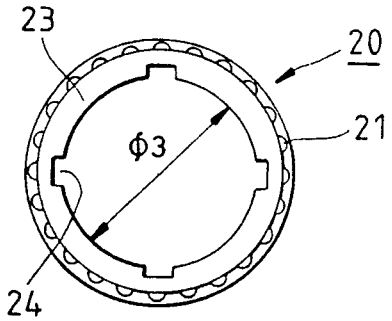
FIG. 4 shows a front elevational view of the fastening ring as shown in FIG. 2.
Figure 5:
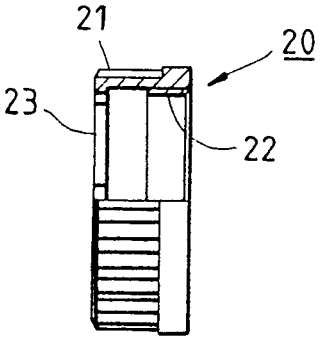
FIG. 5 shows a partial sectional view of the fastening ring as shown in FIG. 2.
Figure 6:
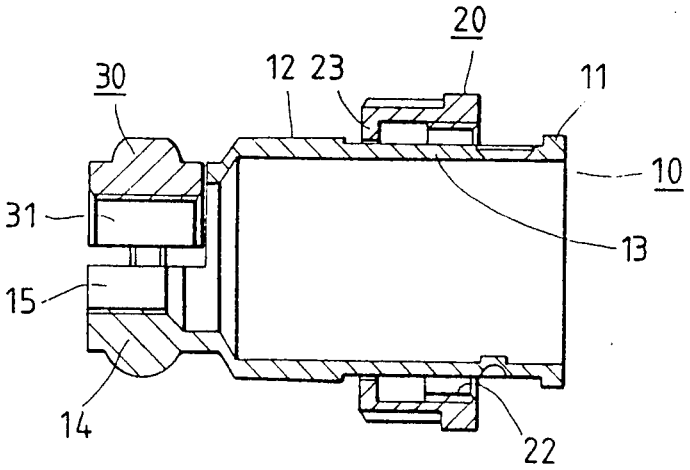
FIG. 6 shows a sectional view of the plug housing fitted into the fastening ring, according to the present invention as shown in FIG. 1.

Referring to FIGS. 1-6, a microphone plug of the present invention is shown to comprise a cylindrical housing 10, a fastening ring 20, and a wire fastening piece 30. The cylindrical housing 10 is made integrally of a plastic material and provided therein with a hollow space for receiving the connection wires and the insulator. The circumferential surface of the front end of the housing 10 has a flange 11 while the rear end portion of the housing 10 is formed as a rear cylindrical segment 12 which has a front end with a diameter $\phi 1$ greater than a diameter $\phi 2$ of a rear end thereof. In other words, the rear cylindrical segment 12 is of a tapered construction. Located between the flange 11 and the rear cylindrical segment 12 is a recessed segment 13 having a smaller outer diameter. The wire fastening piece 14 is attached to the outer end of the rear cylindrical segment 12 and provided with a semicircular hole 15. Located near the both ends of the semicircular hole 15 are two threaded holes 16. The fastening ring 20 is made integrally of a plastic material and provided on the circumference thereof with a plurality of ribs 21 arranged axially and annularly to facilitate the fingers of a person to hold thereon to. The fastening ring 20 is provided therein with an inner threaded segment 22. Located inside the outer end of the fastening ring 20 is a retaining ring 23 having an inner diameter $\phi 3$ slightly greater than the rear end diameter $\phi 2$ of the rear cylindrical segment 12 but slightly smaller than the front end diameter $\phi 1$ of the rear cylindrical segment 12. The fastening ring 20 is further provided on the circumference thereof with four indentations 24 for facilitating the fastening ring 20 to be fitted over the housing 10. The wire fastening piece 30 of semicircular construction is made of a plastic material by injection molding and is similar in shape to a wire fastening piece 14 located outside the outer end of the cylindrical housing 10. The wire fastening piece 30 has a semicircular hole 31 with two through holes 32 disposed in the wall forming the semicircular hole 31. The communication wires are fastened in the plug by means of two screws 33, which pass through the two through holes 32 to engage the two threaded holes 16 of the wire fastening piece 14.

In combination, the cylindrical housing 10 contains therein an insulator, guide wires and a connection terminal (not shown in the drawings). The retaining ring 23 of the fastening ring 20 has an inner hole with the diameter $\phi 3$ slightly greater than the diameter $\phi 2$ of the outer end of the rear cylindrical segment 12 of the housing 10. As a result,, the retaining ring 23 of the fastening ring 20 can be fitted over the rear cylindrical segment 12 in such a manner that the fastening ring 20 can be forced to move forward to pass the area having a greater diameter $\phi 1$ so as to enter the recessed segment 13. Thereafter, the retaining ring 23 regains its original shape so that the retaining ring 23 does not disengage the housing 10 in view of the fact that the inner diameter $\phi 3$ of the fastening ring 23 is smaller than the flange 11 and the outer diameter $\phi 1$ of the front end of the rear cylindrical segment 12. The fastening ring 20 can be moved to allow its inner threaded segment 22 to engage a jack of a communication main machine.

The retaining ring 23 of the fastening ring 20 is provided with a plurality of indentations 24, which enable the retaining ring 23 to deform so as to be forced to pass through the rear cylindrical segment 12 having a greater outer diameter. The size and the number of indentations 24 depend on the extent of deformation of the retaining ring 23. In other words, the size and the number of indentations 24 of the retaining ring 23 must be just right so as to ensure that the fastening ring 20 can be fitted over the cylindrical housing 10 easily and securely.

Figure 7:
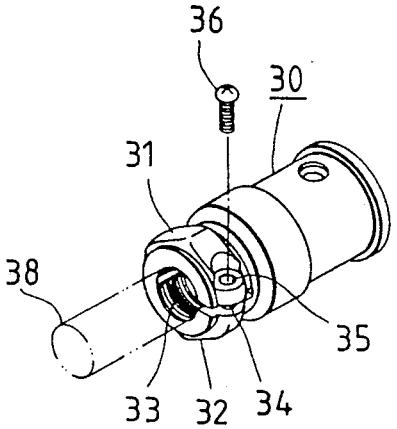
FIG. 7 shows an exploded view of a plug housing of another preferred embodiment of the present invention.

As shown in FIG. 7, another preferred embodiment of the present invention is generally similar in construction to the preferred embodiment described previously, with the only difference being that the former is provided with an upper wire fastening piece 31 and a lower wire fastening piece 32, which are formed by injection molding at one end of a cylindrical housing 30 in such a manner that both ends of the wire fastening pieces 31 and 32 are formed integrally and that another ends of the wire fastening pieces 31 and 32 are formed apart. The opposite surfaces of the wire fastening pieces 31 and 32 form jointly a round hole 33 having an inner diameter slightly larger than an outer diameter of a communication wire 38. The separated ends of the wire fastening pieces 31 and 32 are provided with a threaded hole 34 and a through hole 35. Therefore, the communication wire 38 can be fastened securely in place by means of a screw 36 which engages the threaded hole 34.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A communication plug comprising:

a cylindrical housing made integrally of a plastic material and provided therein with a space for receiving therein a guide wire and an insulator, said cylindrical housing having a front end provided thereon with a flange and having a rear end provided with a rear cylindrical segment and further having a recessed segment located between said flange and said rear cylindrical rear segment, said recessed segment having an outer diameter smaller than an outer diameter of said flange and an outer diameter of said rear cylindrical segment provided at the outer end thereof with at least one wire fastening piece; and a fastening ring of a plastic material and having therein an inner threaded segment and further having at one end thereof a retaining ring;

wherein said rear cylindrical segment has an inner end, which is adjacent to said recessed segment and which has an outer diameter greater than an outer diameter of an outer end of said rear cylindrical segment; wherein said retaining ring has an inner hole with a diameter greater than said outer diameter of said outer end of said rear cylindrical segment but smaller than said outer diameter of said inner end of said rear cylindrical segment; and wherein said retaining ring of said fastening ring is forced to deform so as to pass through said rear cylindrical segment to be secured in place over said recessed segment at the time when said fastening ring is fitted over said cylindrical housing.

2. The communication plug according to claim 1 wherein said retaining ring of said fastening ring has a circumference provided with a plurality of indentations.

3. The communication plug according to claim 1 wherein said cylindrical housing has one end provided with an upper wire fastening piece and a lower wire fastening piece which are made integrally in such a manner that one end of said upper wire fastening piece and one end of said lower wire fastening piece are united respectively with said cylindrical housing, and that another end of said upper wire fastening piece and another end of said lower wire fastening piece are urged by a fastening means so as to hold securely a communication wire received in a wire hole formed jointly by said one end of said upper wire fastening piece and said one end of said lower wire fastening piece.

* * * * *